United States Patent [19]

Schneider et al.

[11] 4,388,745

[45] Jun. 21, 1983

[54] SELF CLOSING MULTI PINTLE HINGE

[75] Inventors: Eberhard Schneider; Theodor Vitt; Gerd Sturm, all of Cologne, Fed. Rep. of Germany

[73] Assignee: Prämeta Präzisionsmetall-und Kunststofferzeugnisse G. Baumann & Co., Fed. Rep. of Germany

[21] Appl. No.: 147,977

[22] Filed: May 8, 1980

[30] Foreign Application Priority Data

May 9, 1979 [DE] Fed. Rep. of Germany ..... 2918659

[51] Int. Cl.[3] ..... E05D 3/06; F05F 1/12

[52] U.S. Cl. ..... 16/288; 16/368

[58] Field of Search ..... 16/50, 189, 145, 288, 16/302, 368

[56] References Cited

U.S. PATENT DOCUMENTS 4,251,900 2/1981 Lautenschlager ..... 16/50 X

FOREIGN PATENT DOCUMENTS 4023 9/1979 European Pat. Off. ..... 16/288
2700606 7/1978 Fed. Rep. of Germany ..... 16/50
2241941 8/1978 Fed. Rep. of Germany ..... 16/50
2804243 8/1978 Fed. Rep. of Germany ..... 16/50
2749288 11/1978 Fed. Rep. of Germany ..... 16/50
2836020 3/1979 Fed. Rep. of Germany ..... 16/288
1387164 3/1975 United Kingdom .
1415871 12/1975 United Kingdom .
1472110 5/1977 United Kingdom .
1484294 9/1977 United Kingdom .
1508034 4/1978 United Kingdom .
1539249 1/1979 United Kingdom .
2022682 12/1979 United Kingdom .
2031059 4/1980 United Kingdom ..... 16/50
2049800 12/1980 United Kingdom ..... 16/288

*Primary Examiner*—Werner H. Schroeder
*Assistant Examiner*—Andrew M. Falik
*Attorney, Agent, or Firm*—Neil F. Markva

[57] ABSTRACT

A wide-angle hinge assembly includes a frame hinge section and a door leaf hinge section connected to one another by a linkage arrangement. The linkage arrangement includes two double-armed link members and an intermediate link. The double-armed link members are pivotable about a common pivot point, and one of the link members pivotally engages one end of the intermediate link having its other end pivotally connected to the leaf hinge section. The linkage arrangement further includes a spring mechanism that is effective to provide a closing pressure during closing and maintaining the closed position for securing the door leaf. The spring mechanism is arranged on the intermediate link and coacts with a cam component included as a part of the leaf hinge section.

9 Claims, 2 Drawing Figures

SELF CLOSING MULTI PINTLE HINGE

FIELD OF INVENTION

This invention relates to a wide-angle hinge assembly for use in a concealed arrangement. More particularly, the hinge assembly has an opening angle up to about 180° and is used for furniture.

BACKGROUND OF THE INVENTION

There are various known constructional forms of wide-angle hinges. Such a known hinge assembly comprises a hinge section on the frame and a door leaf hinge section secured to the wing or door leaf. The hinge sections are connected to one another by double-armed link members pivotable about a common pivot. One of the link members is hingedly connected to the door leaf hinge section by an intermediate link. Such a linkage arrangement includes a spring mechanism which provides a closing pressure to the assembly and locks the door leaf in a closed position.

With one constructional form of such a door hinge assembly, a spring loaded pressure member is arranged in the region of the common pivot axis. The pressure member is arranged on one of the double-armed link members and bears on the free end of the other link member which is formed as a control cam. A helical spring is used as the spring element in this known hinge assembly.

With another known constructional form of wide-angle hinge, a spring lever is mounted on the common axis or pivot of the double-armed link members. The spring lever cooperates with a latching action at its free end portion with the pivot of the intermediate link in the closed position of the hinge. In this instance, the spring mechanism is located on the linkage of the double-armed link members which are pivotable in scissor-like fashion with one another about a common pivot point. It is necessary to have a high precision with respect to the various components used in the hinge assembly to ensure the engagement of the members in association with the spring mechanism. Furthermore, it is extremely difficult to convert the normal hinge into a spring hinge and vice versa. Thus, neither of these known constructional forms of wide-angle hinge assembly is satisfactory.

SUMMARY OF THE INVENTION

The primary object of the invention is to provide a wide angle hinge assembly for use in a concealed arrangement. The hinge assembly has an opening range of up to about 180°. The linkage of the double-armed link members which are pivotable about a common point is free from a spring mechanism. Thus, the hinge assembly can be quickly and easily converted from a normal hinge into a spring hinge and vice versa. A closing force is operable over a long distance in the hinge assembly of this invention. The spring mechanism of the hinge assembly as described herein is disposed on the intermediate link and cooperates with a cam component located on the leaf hinge section of the hinge assembly.

According to another feature of the invention, a double-armed lever is rotatably mounted on the inside of the intermediate link. One arm of the double-armed lever faces the leaf hinge section and engages the fixed cam component of the leaf hinge section. A pulley or roller may be located on the lever. The control cam of the cam component is effective to have the lever arm or the pulley bear on the end portion of a shoulder of the cam component in the closed position of the hinge assembly. The further path of the control cam has an arcuate limit. The free end of the lever may carry at least one attachment for receiving a helical compression spring. The spring is supported against the inside of the intermediate link.

Another feature of the invention is directed to the construction of the cam component. An interchangeable cam component is fixedly arranged on the leaf hinge section and includes a pin-like stem which is fitted into a corresponding bore. The relationship between the stem and the bore is such that the cam component is secured against turning movement. For example, the stem may have a polygonal cross section. With this arrangement, the cam component may be easily exchanged if worn along the control cam or the like without having to replace the linkage parts of the link members. Thus, there is a considerable saving with respect to the cost of replacement parts and a significant reduction in the amount of storage space required for spare parts.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
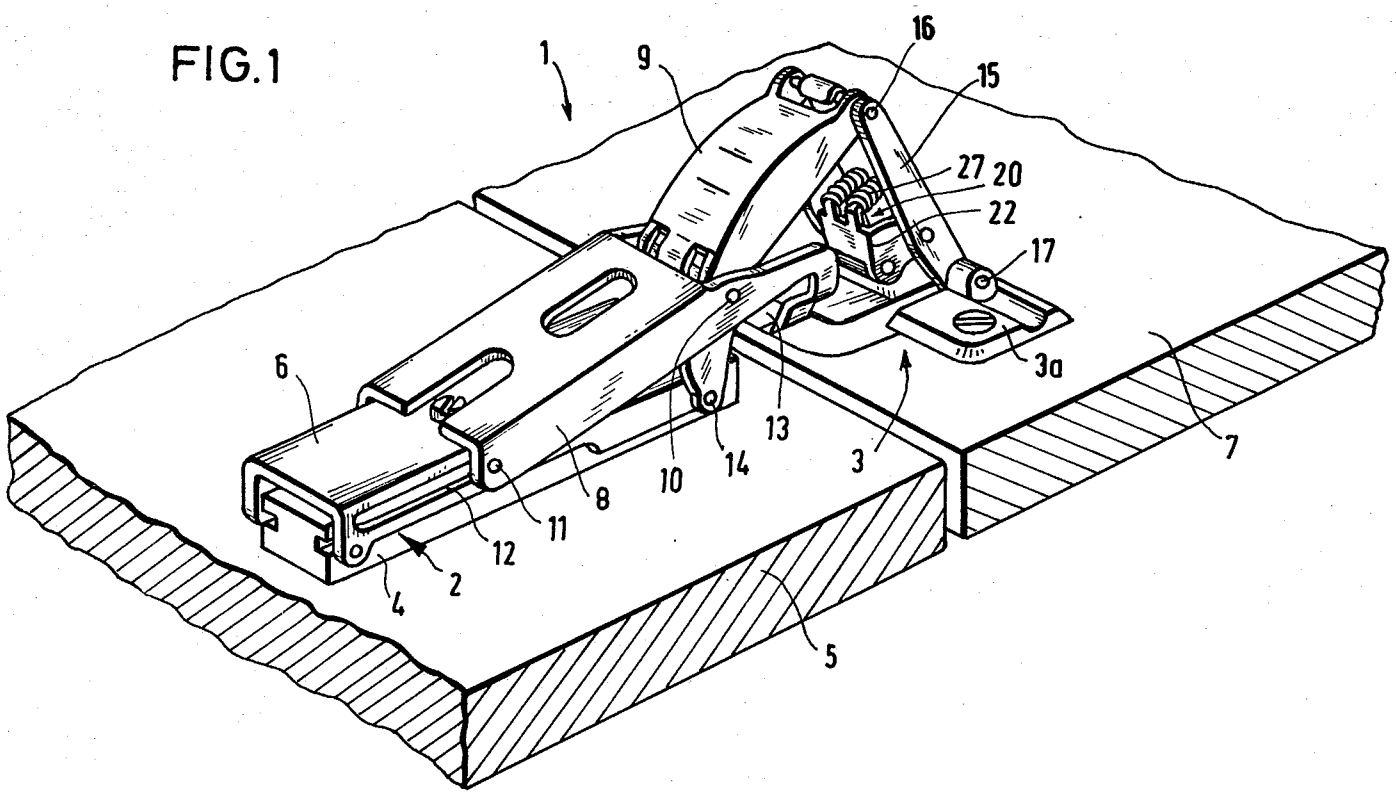
FIG. 1 is a diagrammatic perspective view of a spring hinge with a wide opening range according to the invention and shown in the open position.
Figure 2:
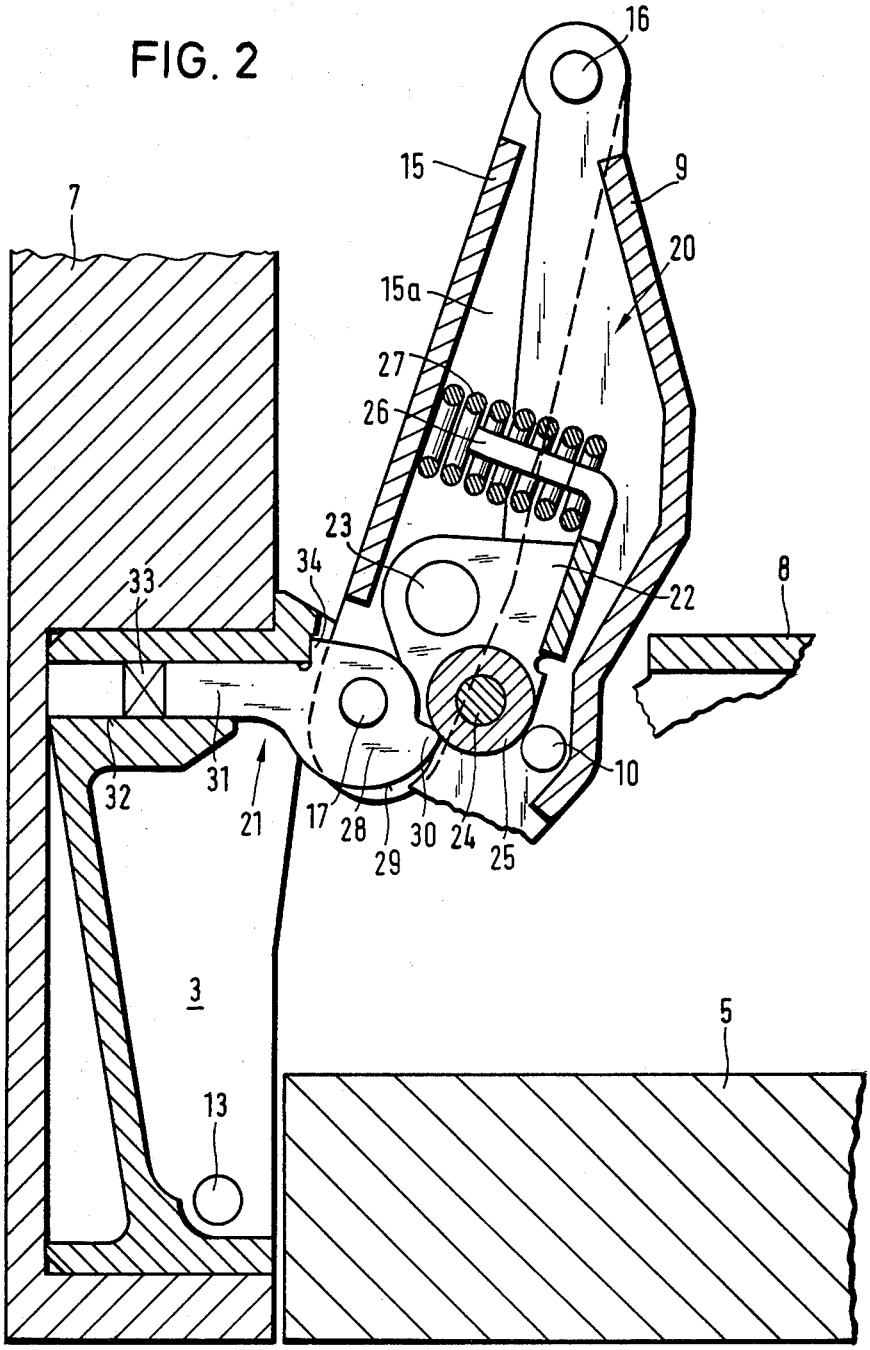
FIG. 2 is a sectional view through the intermediate link in association with a leaf hinge part and diagrammatically shows the coaction of the spring mechanism.

The hinge, generally designated 1, has a wide opening range of up to about 180° and comprises a frame hinge section 2 and a wing or leaf hinge section 3. In this embodiment, the frame hinge section 2 includes a base plate 4 fixed on a frame 5 and an intermediate part 6 fitted axially to base plate 4. The leaf hinge section 3 has a cup-like form in a corresponding recess in leaf 7 and a screwplate **3*a* fixed to leaf 7 with screws as shown. The linkage mechanism between frame hinge section 2 and leaf hinge section 3 comprises the double-armed link members 8 and 9 hingedly connected to one another and in scissor-like form with respect to one another about a common pivot 10. Guide pin 11 is disposed at one end of double-armed link member 8 and movably disposed in a longitudinal groove of the intermediate part 6. Link member 8 is hingedly connected at the other end thereof to a pivot 13 of leaf hinge section 3. The other double-armed link member 9 is hinged at one end on pivot 14 of intermediate part 6 and is pivotally connected at the other end to an intermediate or further link 15. Link 15 is hingedly connected at pivot 16 to double-armed link member 9 and hingedly connected at pivot 17 to the leaf hinge section 3**.

The spring mechanism 20 is arranged directly on the intermediate link 15 and coacts with a cam portion or component 21, which is fixedly mounted in leaf hinge section 3. A double-armed lever 22 is pivotally mounted on the inside of intermediate link 15 about a pivot 23. Pivot 23 is mounted in the sides **15*a* of intermediate link 15. One arm of the double-armed lever 22 includes a pivot 24 which rotatably carries a pulley or roller 25**.

The other arm of the double-armed lever 22 includes at least one bent-over extension 26. A helical compression spring 27 is fitted over extension 26 and is supported at one end on the inside of intermediate link 15 and at the other end on lever 22. In this embodiment, lever 22 is made as a U-shaped part. The pulley or roller 25 is disposed between the cheek portions of the U-shaped lever 22.

The cam component 21 includes cam 28 having control surface 29 which extends along an arc with respect to the center of pivot 17. Cam 28 comprises a nose-shaped end part 30 against which the lever arm of lever 22 or roller 25 comes to bear in the closed position of the hinge section. Thus, the hinge sections are locked in the closed position under the compression of spring 27. Upon opening the hinge 1, roller 25 slides along the arcuate cam surface 29 causing hinge sections 2 and 3 to be held under uniform tension during the opening and closing operations. During these movements, the only pressure point to be overcome is directly at the latching position. The tightening mechanism permits a smooth transfer from the latching position into the opening movement and from the closing movement once again into the latching position.

Cam component 21 includes a stem 31 fitted into a hole 32 located in hinge section 3. Advantageously, stem 31 and bore 32 have a rectangular cross-section 33 to secure cam component 21 against turning movement. Projection 34 of component 21 comes into a bearing position on the leaf hinge section 3. Cam component 21 can be easily exchanged for another component having a cam portion 28 of different shape or, in the event of wear, can be replaced by a new cam component. Thus, the closing pressure for the leaf hinge section can be easily and quickly changed by replacing cam component 21 with a component having a different shape of cam.

ADVANTAGES OF THE INVENTION

The construction of the spring hinge assembly made in accordance with this invention provides a spring influence of the hinge sections that is effective over the entire opening range. The cam component is fixedly arranged on the leaf hinge section. A smooth tightening mechanism is obtained with the spring hinge with the guide linkage being able to be held in synchronism in the tensioned position. A uniform opening and closing operation is produced under the spring action of the hinge assembly made in accordance with this invention.

The spring mechanism of this assembly is completely arranged in the additional link member, that is, the intermediate link. Thus, it is possible to change over from a normal hinge to a spring hinge and vice versa only by effecting the change of the intermediate link member. It is also possible for the cup to be kept and stocked together with the intermediate link as a spring assembly part adjusted and adapted to one another.

While the hinge assembly has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A wide-angle hinge assembly for use in a concealed arrangement for opening and closing a door leaf with respect to a frame, said assembly comprising:

(a) a frame hinge section and a door leaf hinge section connected to one another by a linkage arrangement, (b) said linkage arrangement including two double-armed link members and a further link, (c) said double-armed link members are pivotable in a scissor-like fashion with one another about a common pivot, and one of the link members pivotably engages one end of the further link which further link has its other end pivotally connected directly to the leaf hinge section, (d) the linkage arrangement including a spring mechanism having a double-armed lever rotatable about a pivot and arranged on the further link, (e) said lever including a cam follower, and (f) a cam component disposed on the leaf hinge section to coact with the spring mechanism throughout the entire opening and closing of the door leaf to provide a pressure during opening and closing and to further maintain the closed position for securing the door leaf.

2. An assembly as defined in claim 1 wherein
the cam component includes an end part and an arcuate cam control surface,
said cam follower bears on said end part through the opening and closing of the door leaf and in the closed position of the hinge assembly.

3. An assembly as defined in claim 2 wherein
the cam component includes a pin-like stem interchangeably fitted in the leaf hinge section.

4. An assembly as defined in claim 3 wherein
the stem of said cam component has a polygonal cross section.

5. An assembly as defined in claim 1 wherein
the lever includes at leat one bent-over extension at its free end for receiving a helical compression spring,
said helical spring is supported against the inside of the further link.

6. An assembly as defined in claim 5 wherein
the cam component includes an end part and an arcuate cam control surface,
said cam follower bears on said end part throughout the opening and closing of the door leaf and in the closed position of the hinge assembly.

7. An assembly as defined in claim 6 wherein
the cam component includes a pin-like stem interchangeably fitted in the leaf hinge section.

8. An assembly as defined in claim 7 wherein
the stem of said cam component has a polygonal cross section.

9. An assembly as defined in any one of claims 1, 5 or 6 wherein
the further link is pivotally supported directly at the cam component which is fixed with respect to the door leaf hinge portion.

* * * * *